US006734755B2

(12) United States Patent
Cites et al.

(10) Patent No.: US 6,734,755 B2
(45) Date of Patent: May 11, 2004

(54) BROADBAND UNIPLANAR COPLANAR TRANSITION

(75) Inventors: Jeffrey S. Cites, Horseheads, NY (US); Sean M. Garner, Elmira, NY (US); L. Christopher Henning, Corning, NY (US); Fang Wen, Corning, NY (US)

(73) Assignee: Corning Incorporated, Corning, NY (US)

( * ) Notice: Subject to any disclaimer, the term of this patent is extended or adjusted under 35 U.S.C. 154(b) by 43 days.

(21) Appl. No.: 10/147,695

(22) Filed: May 16, 2002

(65) Prior Publication Data

US 2003/0214364 A1 Nov. 20, 2003

(51) Int. Cl.[7] ..... H03H 7/38
(52) U.S. Cl. ..... 333/33; 333/26
(58) Field of Search ..... 333/26, 33, 246, 333/238, 260, 34, 125, 127, 128, 137, 239

(56) References Cited

U.S. PATENT DOCUMENTS

| | | | | |
|---|---|---|---|---|
| 3,573,670 A | | 4/1971 | Skobern et al. | 333/33 |
| 4,215,313 A | * | 7/1980 | Chang et al. | 455/326 |
| 4,851,794 A | * | 7/1989 | Williams et al. | 333/33 |
| 4,891,614 A | | 1/1990 | De Ronde | 333/122 |
| 4,906,953 A | * | 3/1990 | Li et al. | 333/33 |
| 5,107,231 A | * | 4/1992 | Knox | 333/109 |
| 5,200,719 A | | 4/1993 | Margulis et al. | 333/34 |
| 5,225,797 A | * | 7/1993 | Schary et al. | 333/125 |
| 5,389,735 A | * | 2/1995 | Bockelman | 174/33 |
| 5,578,974 A | | 11/1996 | Yang et al. | 333/187 |
| 5,633,615 A | | 5/1997 | Quan | 333/33 |
| 5,689,216 A | | 11/1997 | Sturdivant | 333/33 |
| 5,844,450 A | | 12/1998 | Buer et al. | 333/34 |
| 6,033,126 A | * | 3/2000 | Omori et al. | 385/88 |
| 6,100,775 A | | 8/2000 | Wen | 333/33 |
| 6,150,895 A | | 11/2000 | Steigerwald et al. | 333/12 |
| 6,192,167 B1 | | 2/2001 | Kissa et al. | 385/3 |

FOREIGN PATENT DOCUMENTS

| | | |
|---|---|---|
| EP | 0358497 | 3/1990 |
| EP | 1065550 A1 | 1/2001 |
| FR | 2449977 | 9/1980 |

OTHER PUBLICATIONS

"Fabrication Of A Low–Loss Microstrip–Coplanar Transition With The Use Of A Diffraction Photolithographic Technique" Nguyen, et al, Microwave and Optical Technology Letters, Vol 13, No. 4, Nov. 96.

"A Wideband Coplanar Stripline to Microstrip Transition" Suh, et al, IEEE Microwave and Wireless Components Letters Vol. 11, No. 1, Jan. 2001.

"Coplanar stripline to microstrip transition" Simmons, et al, Electronics Letters, Sep. 28, 1995, vol. 31, No. 20.

(List continued on next page.)

*Primary Examiner*—Michael Tokar
*Assistant Examiner*—Linh V. Nguyen
(74) *Attorney, Agent, or Firm*—Juliana Agon

(57) ABSTRACT

A broadband interconnection device (10) used for interconnection between a first transmission line (100) and a second transmission line (200), has a substrate (300) with the first transmission line (100) defined at a first side (310) on a first surface (320), the first transmission line (100) including a signal conductor (120) and at least one ground conductor (121 or 122), a signal conductor (220) of the second transmission line (200) defined on an opposite side (340) of the first surface (310), and a ground plane (260) of the second transmission line (200) on an opposed surface (360), the signal conductor (120) of the first transmission line (100) being electrically connected to the signal conductor (220) of the second transmission line (200) on the first surface (320). On the opposed surface (360), the ground plane (260) of the second transmission line (200), has at least one protrusion (261) aligned with the signal conductor (120) of the first transmission line (100).

19 Claims, 8 Drawing Sheets

OTHER PUBLICATIONS

"Traveling–wave polymeric optical intensity modulator with more than 40 GHz of 3–dB electrical bandwidth" Teng, et al, Appl. Phys. Lett. 60 (13) Mar. 30, 1992.
"Mode Conversion at GCPW–to–Microstrip–Line Transition" Raskin, et al, IEEE Microwave Theory and Techniques, vol. 48, No. 1, Jan. 1, 2000.
"Via–free broadband microstrip to CPW transition" Lin, et al Electronics Letters Jul. 19, 2001, Vol. 37, No. 15.

* cited by examiner

BROADBAND UNIPLANAR COPLANAR TRANSITION

BACKGROUND OF THE INVENTION

1. Field of the Invention

The present invention relates generally to transmission lines, and particularly to transitions between different kinds of transmission lines.

2. Technical Background

Electronic, electro-optic and other devices for high-speed operation at ultra-high microwave frequencies (>10 GHz) are difficult to design because interconnections have unintentional capacitance and inductances, causing undesirable side effects. Simple low frequency interconnects cause attenuation and other parasitic distortions of the microwave signal and therefore the interconnects have to be designed and treated as transmission lines for frequencies higher than the radio frequency (RF) range, including the ultra-high microwave frequencies. Transmission lines, such as microstrip and coplanar waveguides (CPW) are generally not combined on the same substrate. However, to form larger subsystems, such as electro-optic modulators or other high-speed devices, there is a need to be able to connect dissimilar transmission lines, such as a wider CPW signal conductor to a narrower microstrip conductor, with a manufacturable broadband transition that has a minimum and smooth return loss of at least 15 dB across a range of at least DC to 50 GHz.

One example of a larger subsystem is the top surface planar packaging electrode connection to the electrodes of an electro-optic (EO) chip. It is known that high-speed operation of electro-optic (EO) waveguide modulators requires RF transmission lines for the modulator driving electrodes to achieve velocity matching of the electrical and optical signals and to overcome the capacitance limitations of a lumped element drive electrode. Preferably, these transmission lines should have characteristic impedances ($Z_0$) equal to or near 50 Ohms for matching to the drive electronics. Broadband operation is also a requirement of these modulators. According to well-known transmission line theory, the characteristic impedance is dependent on the dielectric between the lines. In general, the optimum geometries for an EO polymer modulator where the dielectric is a polymer, the drive electrode and the lines by which the drive signal is routed into the device package are dissimilar. Therefore, well-designed transitions from one type of RF transmission line to another are usually necessary for efficient, broadband operation of the modulator. Many types of transitions are known. However, none of the known transitions have tied together all of the essential elements for a broadband (DC to 50 GHz), uniplanar CPW to MS transition having a smooth low-return loss, in the context of the unique requirements for driving a high-speed electro-optic (EO) polymer modulator.

Therefore, there is a need for a high frequency, broadband uniplanar transition wherein the transition lies on the same plane/surface as the interconnecting center conductors of two dissimilar transmission line segments for the examplary purpose of driving an EO polymer modulator.

SUMMARY OF THE INVENTION

One aspect of the present invention is a broadband interconnection device used for interconnection between a first transmission line and a second transmission line, having a substrate with the first transmission line defined at a first side on a first surface, the first transmission line including a signal conductor and at least one ground conductor, a signal conductor of the second transmission line defined on an opposite side of the first surface, and a ground plane of the second transmission line on an opposed surface, the signal conductor of the first transmission line being electrically connected to the signal conductor of the second transmission line on the first surface. On the opposed surface, the ground plane of the second transmission line, has at least one protrusion aligned with the signal conductor of the first transmission line.

In another aspect, the present invention includes a second ground shape of a second ground of a second transmission line on a second plane is geometrically configured to interact with a first ground of a first transmission line on a first plane for maintaining a uniform desired characteristic impedance for broadband microwave signal propagation between the first and second transmission lines.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DESCRIPTION OF THE PREFERRED EMBODIMENTS

Figure 1:
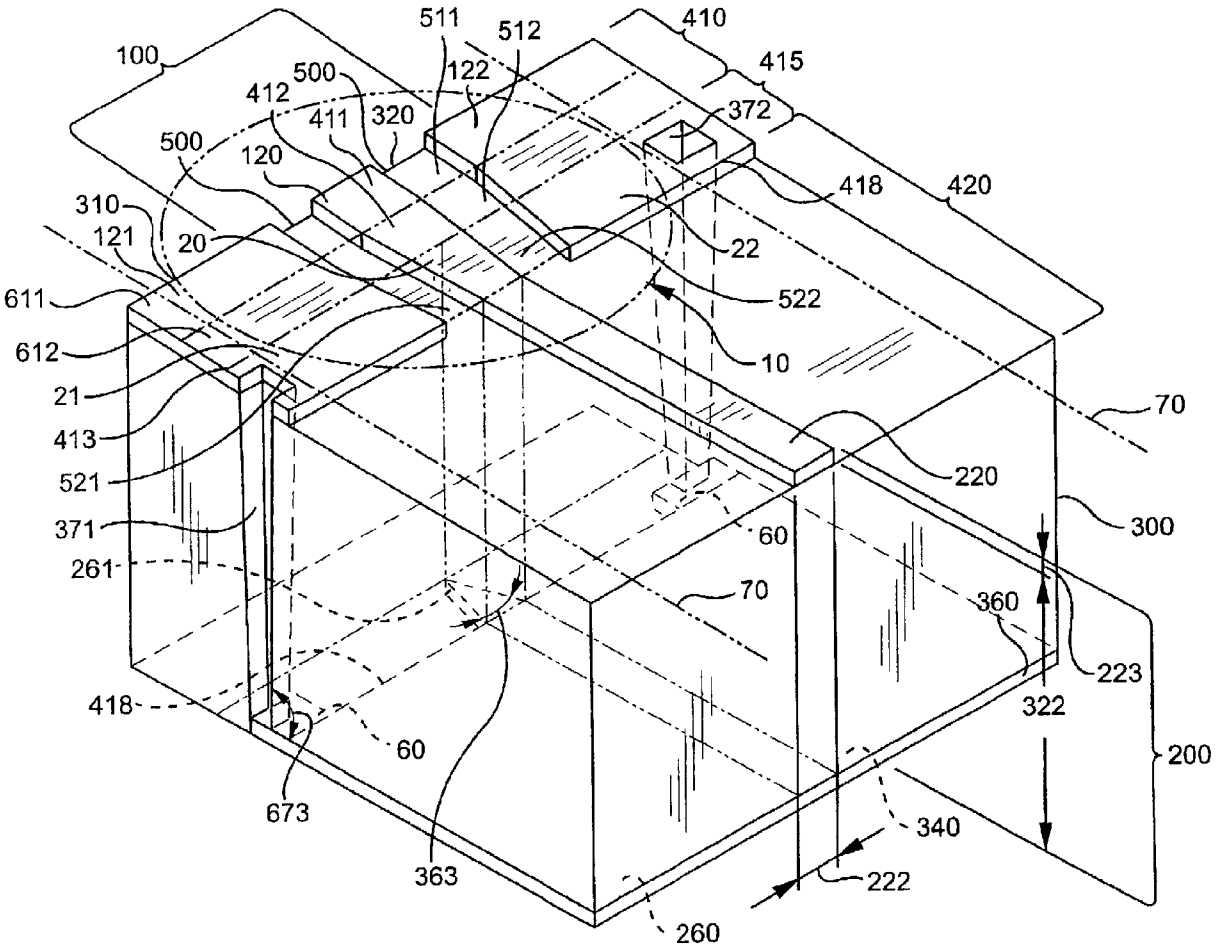
FIG. 1 is a perspective magnification of a transition 10, in accordance with the present invention.

Reference will now be made in detail to the present preferred embodiments of the invention, examples of which are illustrated in the accompanying drawings. Wherever possible, the same reference numbers will be used throughout the drawings to refer to the same or like parts and top and bottom, left and right references can be interchanged and dimensions are not to scale. An exemplary embodiment of the transition, launcher, or any other interconnecting structure of the present invention for providing a broadband uniplanar connection between a first and second transmission line is shown in FIG. 1, and is designated generally throughout by reference numeral 10. The definition of a uniplanar transition is the interconnection between two signal conductors of two dissimilar transmission lines which lie in the same plane.

Referring to FIG. 1, a broadband interconnection device or launcher 10 is used for interconnecting between a first transmission line 100 and a second transmission line 200. The device includes a substrate 300 with the first transmission line 100 defined at a first side 310 on a first plane or top surface 320. The first transmission line 100 includes a signal conductor 120 and at least one ground conductor or planes (121 or 122). A signal conductor 220 of the second transmission line 200 is defined on an opposite side 340 of the first surface 310. On an opposed plane or bottom surface 360 of the substrate 300, another ground plane 260 is disposed for completing the second transmission line 200. The signal conductor 120 of the first transmission line 100 is electrically connected to the signal conductor 220 of the second transmission line 200 on the first surface 320 of the substrate 300. On the opposed surface 360, the ground plane 260 of the second transmission line 200, has at least one protrusion 261 aligned with the signal conductor 120 of the first transmission line 100.

According to transmission line theory, electro magnetic (EM) waves propagate by virtue of some mode related to the relative direction of the electric and magnetic fields. Transverse electro magnetic (TEM), quasi-TEM, TM, and TE are possible modes of propagation along different types of transmission lines. For example, if the transmission line is a coplanar waveguide (CPW), TEM is the mode of propagation. Alternatively, if the transmission line is a microstrip (MS), quasi-TEM is the main mode of propagation. Since both the MS and CPW use planar conductors, the electric field is pointing back and forth: i.e. to and from the signal conductor to the ground terminal (plane). Hence, the electric field 481 is pointing horizontally from the uniform portion of the CPW signal conductor 120 of the first transmission line 100 to the at least one ground conductor 121 or 122 that end in the portions seen in FIG. 4. Analogously, the electrical field 482 is pointing vertically from the MS signal conductor 220 to the MS ground plane 260 that start from the portions seen in FIG. 4. Thus, there is an associated field pattern for this propagation, which suggests polarization of the fields. The CPW ground conductors 121 and 122 and MS ground plane 260 are assumed to be large enough to serve as a good or "infinite" ground plane, according to transmission line theory. However, the associated field pattern for the transmission line propagation, suggesting polarization of the fields, occur only within the transitional area 10 of the infinite ground plane. The portion of this "infinite" ground plane that lay outside of the transitional area 10 will be referenced as common ground area 70 and shown divided by the reference line 70 for illustration purposes. However, the entire broadband transmission line interconnection device, as taught by the present invention will include both portions of the common ground area 70 and the transitional area 10.

Within or in the transitional area 10, the ground plane 260 of the second transmission line 200 on the opposed surface 360 does not have to be connected to the at least one ground conductor or ground plane 121 or 122 of the first transmission line 100 on the first surface 320. However, somewhere in the common ground area 70, away from the transition 10, it is necessary to connect these two ground planes 121 or 122 and 260 with a sufficient number of large, low inductance vias such as 372. This allows for a common low inductance interconnect between the two opposed surface ground planes that will not limit high frequency operation.

Processwise, the top and bottom ground planes 121 or 122 and 260 can be connected by a rectangular via 372 to cause the top ground conductors 121 and 122 and the bottom ground plane 260 to have a common reference for serving as a more perfect ground terminal. Hence, the present invention for the broadband interconnection device or launcher 10 further optionally includes at least one rectangular via 372 having between one to four sloped sidewall conductively coated surfaces 371 in the substrate 300. In FIG. 1, the left via 372 is shown cut, without one sidewall 371 to illustrate the insides of this via 372. The sloped surfaces 371 slant from the common ground 70 region connected to the at least one ground conductor 121 or 122 of the first transmission line 100 on the first surface 320 to a common ground extension 60 of the ground plane 260 of the second transmission line 200 on the opposed surface 360. For providing such a solid ground connection, unfilled or filled-aperture or contact via, one or all of the sloped surfaces 371 are metalized with a high conductivity metal. To complete the ground path, the high conductivity metal of the sloped surfaces 371 are in contact with the common ground extension 60 of the ground plane 260 of the second transmission line 200 and the common ground 70 region connected to the at least one ground conductor 121 or 122 of the first transmission line 100. These sloped surfaces 371 and 372 can be placed anywhere on the substrate 300 where at least one of the top common ground region 70 associated with the top ground conductors 121 or 122 overlap with the bottom common ground extension 60 of the bottom ground plane 260. However, for providing a better ground connection at high frequencies, the pair of sloped surfaces 371 should be placed away from the electrical transitional connection 10 on the first surface 320 of the substrate 300 between the signal conductor 120 of the first transmission line 100 and the signal conductor 220 of the second transmission line 200. Alternatively, as long as the via 372 is placed far away enough from the transitional area 10, the via can be made with an extension to the top common ground region 70, associated with the top ground conductors, instead of the bottom common ground extension 60 to the bottom ground plane 260 or by common ground extensions to both.

Instead of being sloped, the surfaces, filled, or unfilled-vias 372 can instead be straight to make a ninety-degree angle with the bottom common ground extension 60 of the bottom ground plane 260. However, for easier fabrication of the substrate 300, it is easier to make the surfaces 371 slanting. Preferably, the sloped surfaces 371 each subtends an angle 673 of no less than seventy degrees and no more than ninety degrees with the common ground extension 60 of the bottom ground plane 260 of the second transmission line 200 and the top common ground 70 region connected to the top at least one ground conductor 121 or 122 of the first transmission line 100.

As embodied herein, and depicted in FIG. 1, the at least one protrusion 261 of the ground plane 260 has the shape of a taper. Depending on the perspective, the same taper can appear converging or diverging. Hence, these terms are interchangeable. This ground taper can be linear, exponential, logarithmic, cosine squared, parabolic, hyperbolic, cosine squared, Chebychev or follow the shape of other microwave tapers known by those of skill in the art for generally transforming impedances by tapering only the signal conductor. Ground planes, alone, have had their normally rectangular shapes altered in various geometric configuration, such as a saw-tooth form having triangular shapes, stair-shaped, or other modifications, again for better impedance matching or electro-magnetic shielding. However, according to the teachings of the present invention, it is the ground, on one or opposed surfaces, that is inventively adiabatically, progressively, or gradually tapered for broadband transitioning and not for impedance matching at a desired frequency range. In combination with a tapering of the signal conductors 120 and 220, as a first transitioning structure on the first or top surface 320, the tapering of the ground plane, represented by the ground protrusion 261, provides an additional or second transitioning structure for broadband transitioning or launching.

Figure 4:
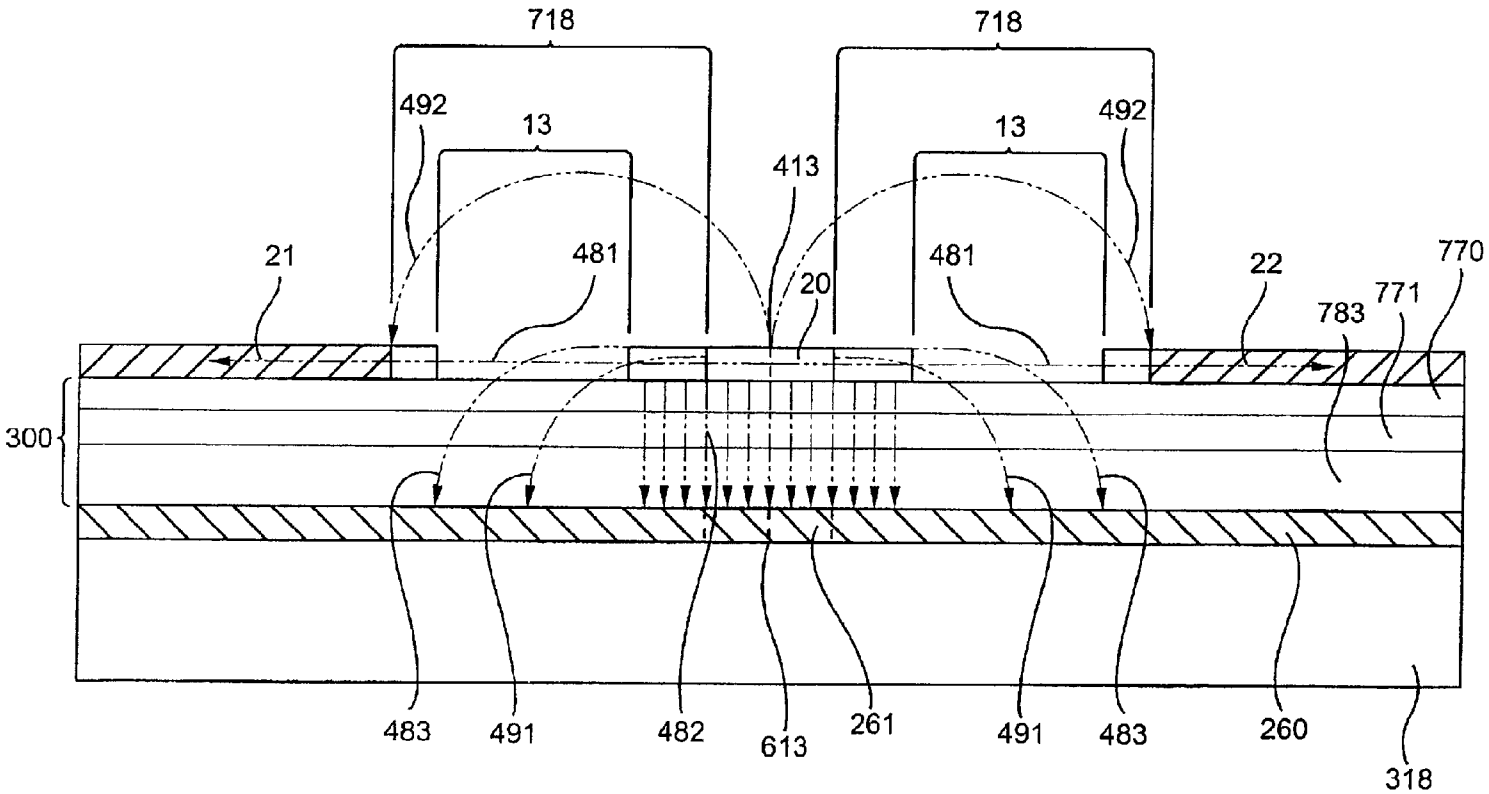
FIG. 4 is a is a cross-sectional view of the transition 10 in the modulator 700 of FIG. 3, taken through MS boundary interface line 418 in FIG. 3, in accordance with the present invention.
Figure 5:
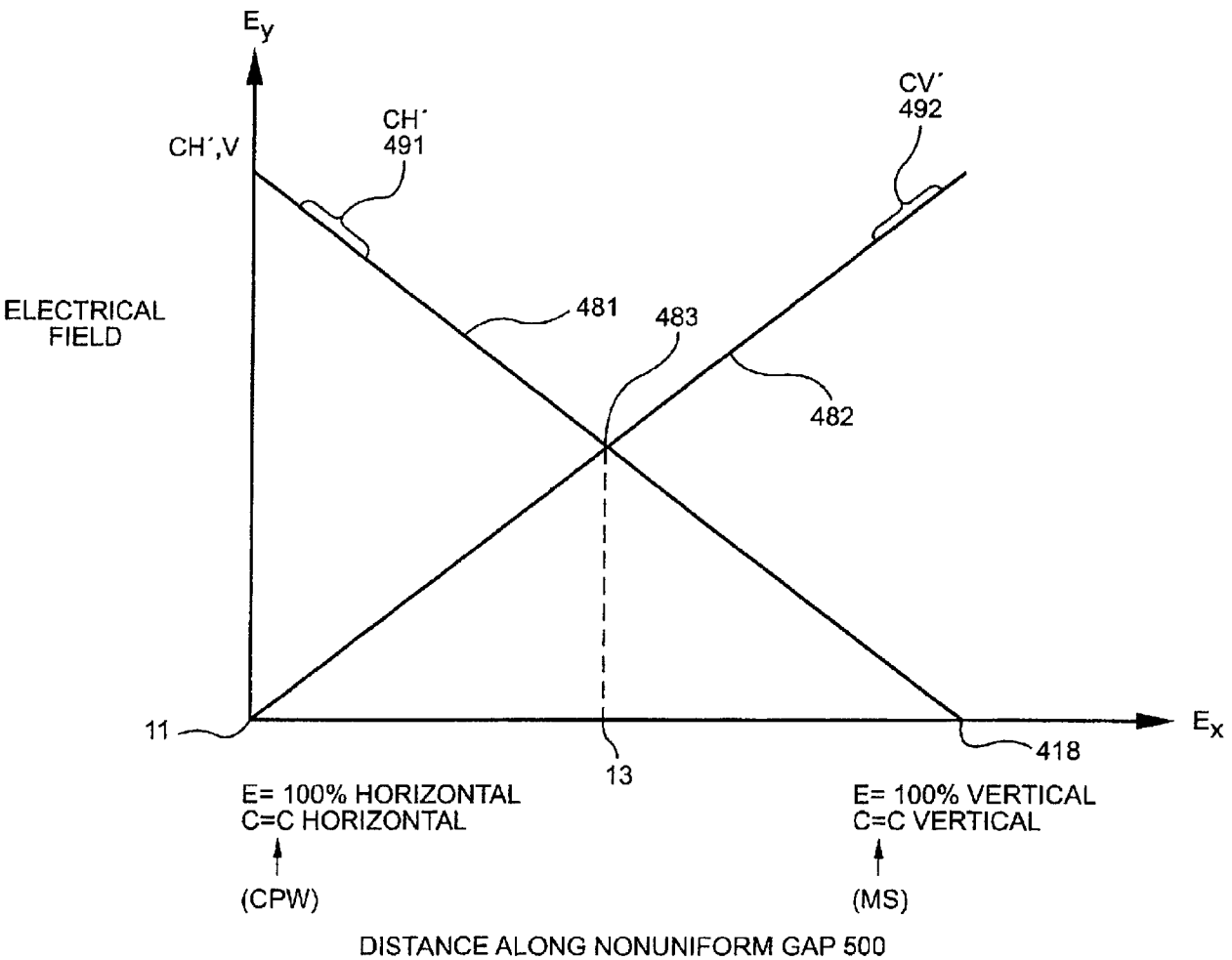
FIG. 5 is a chart showing the symmetrical capacitances changes to rotate a horizontal field to the vertical axis, in accordance with the present invention.

According to the teachings of the present invention, the at least one protrusion 261 of the ground plane 260 is symmetrically aligned with the signal conductor 120 of the first transmission line 100. Referring to FIGS. 1, 4, and 5, the at least one protrusion 261 is gradually tapered to provide a gradual vertical capacitance change 492 between the first 320 and opposed 360 surfaces that is substantially equal to a gradual horizontal capacitance change 491, at point 13, provided between the signal conductor 120 of the first transmission line 100 and the at least one ground conductor 121 or 122, that is also preferably tapering, on the first surface 320 to gradually rotate a horizontal electric field 481 to a vertical electric field 482. It is known that according to transmission line theory, the more overlay there is between top and bottom conductors, whether the conductors are signal or ground conductors, the more capacitance there is between the conductors or metalized layers. Hence, a continuous transmission path is provided between the first 100 and second 200 transmission lines at a uniform characteristic impedance, that is generally about 50 ohms, from the first side 310 to the opposite side 340 for optimum broadband transitioning.

Accordingly, a broadband transmission line interconnection device 10 is taught where the second ground shape 261 of the second ground 260 of the second transmission line 200 on the second plane 360 is geometrically configured to interact with the first ground 121 of the first transmission line 100 on the first plane 320 for maintaining a uniform desired characteristic impedance for broadband microwave signal propagation between the first 100 and second 200 transmission lines.

This geometrically configured ground shape of the second transmission line, exemplified by a ground tapering structure, could easily be modified for many other coplanar transmission line structures. For example, even though the first transmission line 100 is exemplified by a coplanar waveguide (CPW) in FIG. 1, with the CPW signal conductor 120 and the pair of CPW ground conductors or CPW ground planes 121 and 122 symmetrically or non-symmetrically flanking the CPW signal conductor 120, a coplanar strips transmission line can be denoted instead by using the signal conductor 120 and only one of the ground conductors 121.

Similarly, the second transmission line 200 is exemplified by a microstrip (MS) configuration in FIG. 1 where the MS signal conductor 220 overlays a MS ground plane 260. However, the ground plane 260 can include at least one slot (not shown in FIG. 1 but shown in FIG. 8) for providing a slotted ground microstrip (SGMS) transmission line structure, useable with the present invention.

With any type of coplanar transmission lines, it is the ground plane of the second transmission line shaped and aligned with a suitable shape of the first transmission line that inventively provides the broadband transitioning. In accordance with the guidance of the present invention, suitable shapes and alignment of the first and second transmission lines can be realized and refined by appropriate computer simulation by those well-versed in the microwave arts for a particular type of coplanar transmission line combination. Even for one particular type of coplanar transmission line combination, various shaping and alignment is possible for the two coplanar transmission lines.

Figure 2:
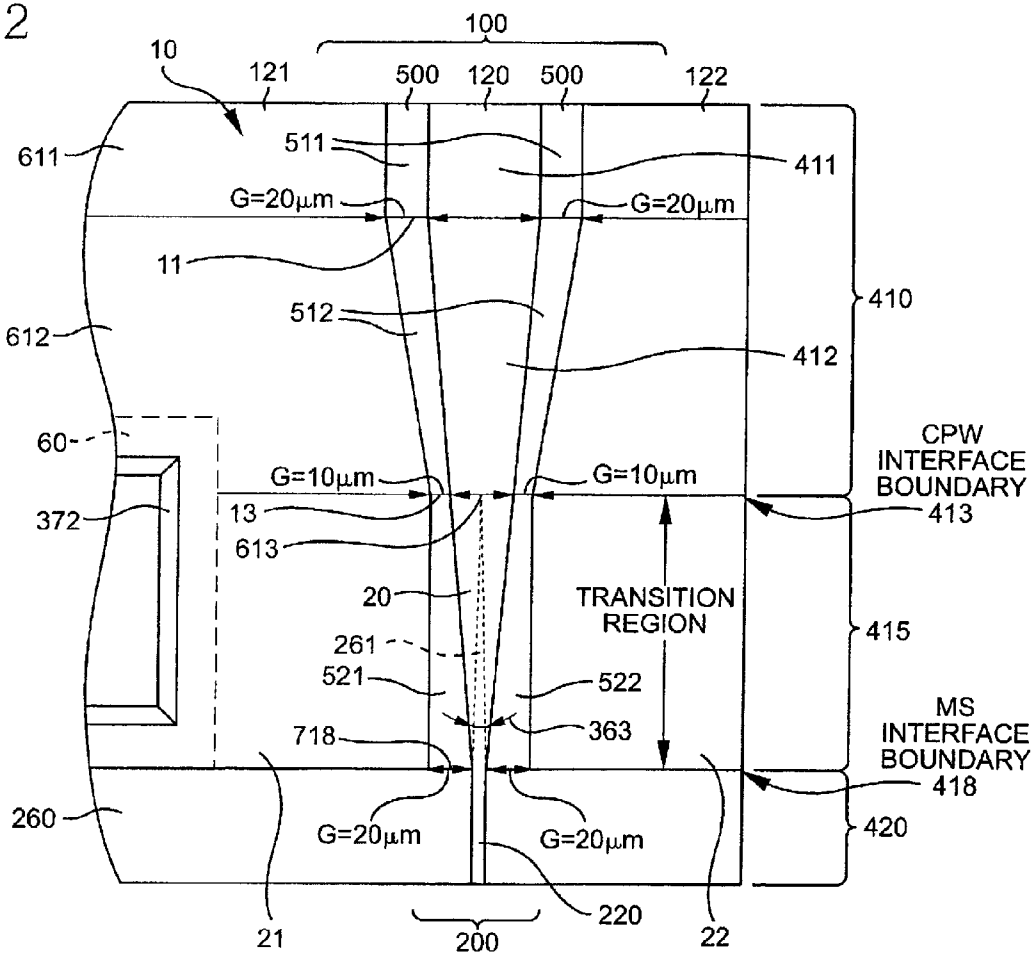
FIG. 2 is a top planar view of the transition 10 of FIG. 1, in accordance with the present invention.

For example, referring to FIGS. 1 and 2, a first embodiment of a particular broadband coplanar waveguide (CPW) transmission line to microstrip (MS) transmission line transition is next described in more detail to show how the continuous transmission path is provided without limitation to a band of frequencies with one type of shaping and alignment. For this CPW-to-MS transition example, using the same numbering and components already described, a coplanar or CPW region 410 is defined where a central conductor or CPW signal conductor 120 has a finite uniform width CPW portion 411 and a nonuniform width CPW portion 412, within this CPW region 410. The finite width portion of the central conductor or CPW signal conductor 120, is disposed between a left ground conductor 121 and a right ground conductor 122 on the first surface 320 to support a horizontal electric field between the central or CPW signal conductor 120 and the left and right or CPW ground conductors 121 and 122. These CPW ground conductors 121 and 122 serve as the first ground on the first plane 320.

A microstrip region 420 is next defined where there is a MS signal conductor 220 on the first surface 320 and a microstrip (MS) ground plane 260 on the opposed surface 360 for supporting a vertical electric field with the MS signal conductor 220.

In between the microstrip region 420 and the CPW region 410, a transitional region 415 exists and is bounded by a microstrip interface boundary 418 and a coplanar waveguide interface boundary 413. The coplanar waveguide interface boundary has electric fields that are predominantely horizontal in direction relative to the microstrip line interface boundary, wherein the microstrip electric fields are predominantly vertical in orientation. Within this transitional region 415, a conductive extension 20 of the CPW central conductor 120 of the coplanar or CPW region 410 electrically connects with the MS signal conductor 220 of the microstrip region 420 on the first surface 320 between the microstrip interface boundary 418 and the coplanar waveguide interface boundary 413. This electrical connection between the CPW conductive extension 20 and the MS signal conductor 220 on the first surface or plane 320 forms a first transition structure for launching a polarized electric field of a signal in the CPW transmission line 100 and the polarized electric field of the signal in the MS transmission line 200.

As an example of the geometrical configuration of the second ground, at least one ground protrusion 261 of the microstrip ground plane 260 on the opposed surface 360 of the microstrip region 420 is aligned with the CPW central conductor 120 to form a grounded closed conductive path opposite the CPW central conductor 120 for supporting a gradual transfer of the horizontal electric field between flanking conductive layers of the coplanar region 410 to the vertical electric field from top and bottom conductive layers of the microstrip region 420 distributed about the central CPW conductor 120. The at least one ground protrusion 261 protrudes from the microstrip interface boundary 418 and gradually approaches the coplanar waveguide interface boundary 413.

Still within the transitional region 415, a pair of CPW ground conductor end portions 21 and 22 of the left 121 and right 122 ground conductors on the first surface 320 of the coplanar region 410 is aligned with the at least one ground MS protrusion 261 on the opposed surface 360 of the MS ground plane 260 of the microstrip region 420. The pair of CPW ground conductor end portions 21 and 22 extend from the coplanar waveguide interface boundary 413 and gradually approaches the microstrip interface boundary 418 until intersecting the MS interface boundary 418 where the pair of ground conductor end portions are maximally coinciding in an orthogonal plane with the at least one ground protrusion 261. This maximum coincidence of the pair of CPW end portions 21 and 22 and the MS ground protrusion 261 in the same orthogonal plane causes the horizontal electrical field lines of the pair of CPW ground conductor end portions 21 and 22 to gradually converge with the vertical electrical field lines of the at least one MS ground protrusion 261. Meanwhile, the horizontal electric field lines of the at least one MS ground protrusion 261 gradually diverges inside the transitional region 415 between the microstrip 418 and coplanar waveguide 413 interface boundaries. Because there is a combination of horizontal and vertical electric fields at the point 13, and not just horizontal fields for the CPW, the line including this point 13 is called the coplanar waveguide interface boundary 413.

Hence, the pair of CPW ground conductor end portions 21 and 22 aligned with the at least one MS ground protrusion 261 forms a second transition structure for gradually rotating the horizontal electric field component on the CPW transmission line 100 to a vertical electric field component on the MS transmission line 200 prior to the signal entering the microstrip region.

For maintaining a uniform desired characteristic impedance, such as substantially 50 ohms, for broadband microwave signal propagation between the CPW and MS transmission lines 100 and 200 to provide minimum discontinuity or a return loss less than 15 dB from the 0 (DC) to at least 50 GHz, a pair of gap trenches, spacing, or separation between the CPW conductors 121, 120, and 122 is predefined based on the width of the CPW central conductor 120, and the dielectric constant of the substrate 300. As already described, the CPW central conductor 120 has the finite uniform width CPW signal portion 411, the nonuniform width CPW signal portion 412, and the conductive extension 20. Similarly, each of the CPW ground conductors 121 and 122 has a finite uniform width CPW ground portion 611, a nonuniform width CPW ground portion 612, and the pair of already described CPW ground conductor end portions 21 and 22. To complete the CPW transmission line 100 at the same characteristic impedance, each of the gap trenches 500 has a finite uniform width gap portion 511, a nonuniform width gap CPW portion 512, and a nonuniform width transitional gap end portion 521 or 522. Each gap portion is correspondingly disposed between the liked portions of the CPW central or signal conductor 120 and the CPW ground conductors 121 and 122. Hence, the finite uniform width gap portion 511 separates the finite uniform width CPW signal portion 411 from the finite uniform width CPW ground portions 611. The nonuniform width gap CPW portion 512 separates the nonuniform width CPW signal portion 412 and the nonuniform width CPW ground portions 612. Likewise, the nonuniform width transitional gap end portions 521 and 522 separate the conductive extension 20 from the pair of CPW ground conductor end portions 21 and 22.

The width of the uniform gap portion 511 provides the widest gap along the gap trench 500 and is the nominal width of the predefined gap spacing based on the width of the CPW central conductor 120 and the dielectric constant of the substrate 300. At the intersection 11 between the termination point of this widest uniform gap portion 511 and the start of the nonuniform width gap CPW portion 512, the pair of nonuniform width CPW signal portion 412 starts to bend or converge at the widest spacing of the gap trench intersection 11 for minimum discontinuity.

From the gap trench intersection 11 with the widest gap spacing, the nonuniform width CPW ground portions 612 flare inwardly toward the nonuniform width CPW signal portion 412 to progressively narrow the nonuniform width gap CPW portions 512 until the coplanar waveguide interface boundary 413 is reached at the narrowest gap spacing intersection or pinched region 13. At the coplanar waveguide interface boundary 413, the pair of CPW ground conductor end portions 21 and 22 continue the flaring of the ground conductors 121 and 122 but the pair of CPW ground conductor end portions 21 and 22 flare outwardly away from the conductive extension 20 of the central or signal CPW conductor 120 to progressively widen the gap of the nonuniform width transitional gap end portions 521 and 522 until the widest gap spacing is again reached at the microstrip interface boundary to partially complete the transition at the microstrip region.

As part of the geometric configuration of the second ground 260 on the second plane 360, at an apex 613 on the coplanar waveguide interface boundary 413, the at least one ground protrusion 261 flares outwardly toward the pair of CPW ground conductor end portions 21 and 22 until reaching the microstrip interface boundary 418 to progressively narrow a CPW-MS ground separation between the at least one ground protrusion 261 and the pair of ground conductor end portions 21 and 22 to complete the transition. Looking from the top and assuming the subtrate dielectric material 300 underneath is transparent, the at least one ground protrusion 261 is separated from the pair of ground conductor end portions 21 and 22 as the CPW-MS ground separation by the nonuniform width transitional gap end portions 521 and 522 and an unoverlapped distance between the at least one ground protrusion 261 and the conductive extension 20 of the central CPW conductor 20.

Figure 6:
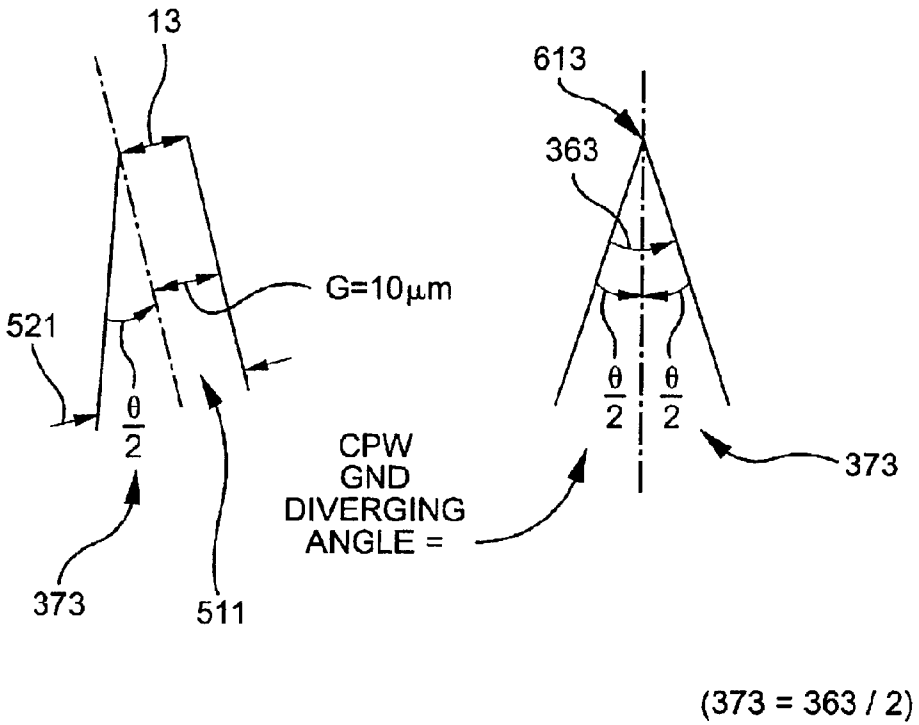
FIG. 6 is a diagrammatic depiction of the relationship between the gap trench 500 and the ground protrusion 261 of FIG. 2, in accordance with the present invention.

Hence, each of the ground conductors 121 and 122 provides a first adiabatic taper converging towards the narrowest gap intersection 13 on the coplanar waveguide interface boundary 413, within the nonuniform width CPW ground portion 612 and a second adiabatic taper diverging away from the narrowest gap intersection 13 on the coplanar waveguide interface boundary 413, within each of the pair of ground conductor end portions 21 and 22. As part of the geometric configuration of the second ground, the at least one ground protrusion 261 provides a third adiabatic taper converging from the widest gap spacing of the gap trench 500 on the microstrip interface boundary 418 towards the apex 613 of the coplanar waveguide interface boundary 413, as seen in FIG. 6. The gap trench 500, in the nonuniform portions 521, 522, and 512 maintains the uniform gap spacing width of the uniform gap portion 511 along the trench while diverging or converging away at the diverging angle 373. The relationship thus formed of the convergence of the at least one ground protrusion 261 is related to the divergence of the pair of ground conductor end portions 21 and 22, such as by a factor of two. Preferably, if the angle of convergence 363 of the at least one ground protrusion 261 is θ, then the divergence angle 373 of the pair of ground conductor end portions 21 and 22 are each at θ/2 because there are two ground conductor end portions 21 and 22.

Hence, referring back to FIG. 2, by adding the extra MS ground plane of the MS ground protrusion 261, the microstrip interface boundary point 718 which would normally have the narrowest gap width of the gap trench for a conventional uncompensated transition for maintaining the characteristic impedance of 50 ohms can now be increased to 20 μm. By having such a resultant convergence and divergence pattern of the gap trench 500, the narrowest gap width of the gap trench 500 at 10 μm can now be moved to the point 13, where there is an equal mix 483 of vertical and horizontal fields as seen in FIG. 5, away from the microstrip interface boundary point 718, of a conventional uncompensated transition.

Even though for simplicity, the subtrate dielectric material 300 is assumed to be transparent, for practicle purposes, the subtrate 300 can be any dielectric. For electro-optic devices, the substrate 300 is preferably a III–V semiconductor material, such as Indium Phosphide (InP), Galium Arsenide (GaAs), a combination of these or other III–V, III–IV and/or materials, such as nitride (N). The substrate 300 could also be opto-ceramic. A crystal, such as lithium niobate could also be used as the substrate 300. However, in the present application for ease of fabrication, the substrate 300 is preferably a polymeric material. As an example of an electro-optic device that could be fabricated with the present invention on the substrate 300, a modulator using a Mach-Zehnder configuration is shown in FIG. 3.

Figure 3:
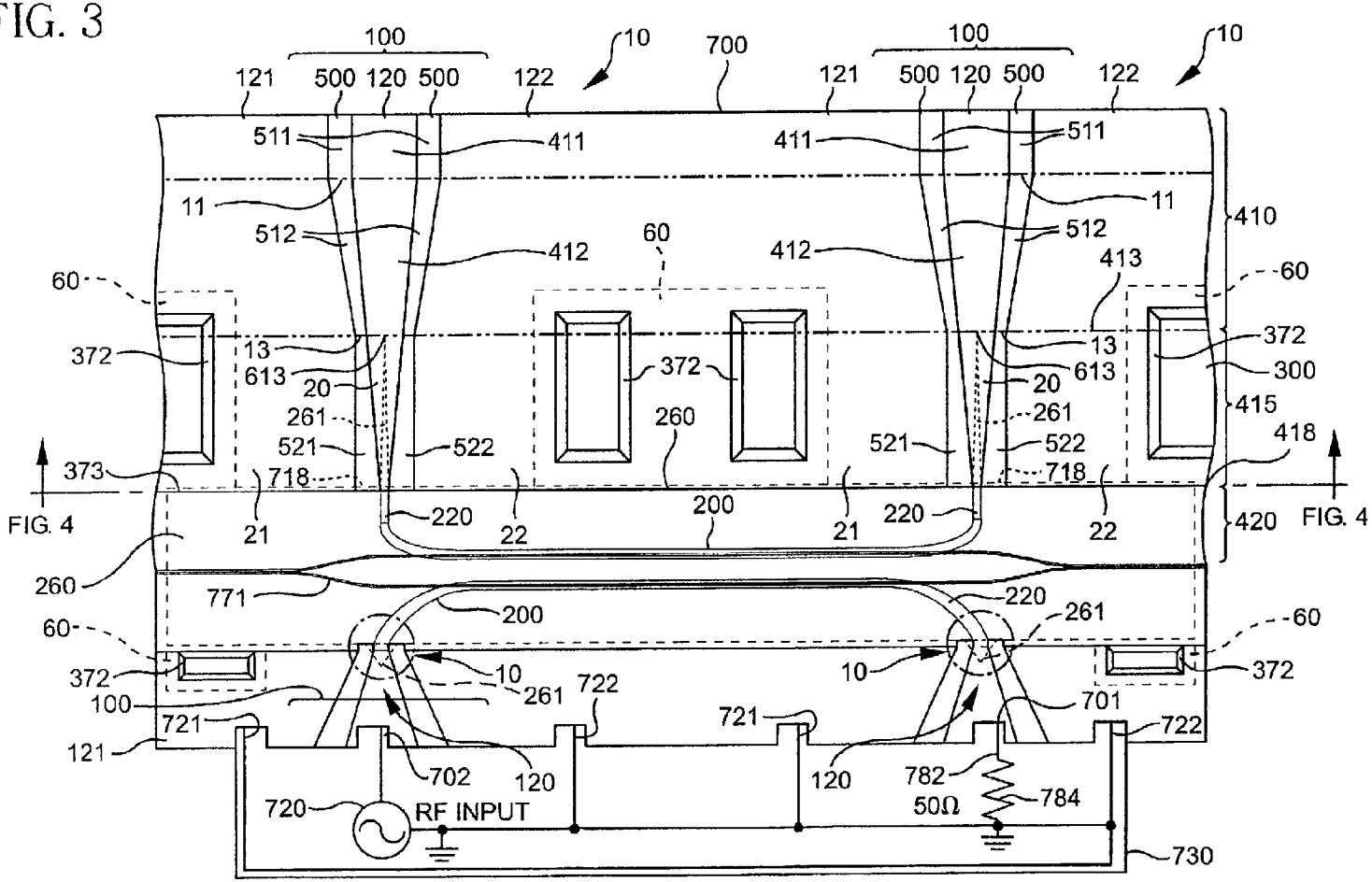
FIG. 3 is a top planar view of the transition 10 of FIG. 2 used in a modulator 700, in accordance with the present invention.

Referring to FIGS. 3–4, an electro-optic modulator 700 is depicted using an enlarged representation of the the broadband interconnection device or launcher 10 of FIG. 2 using the same numbering for the same functions, even though a more specific function may now have a different name. Thus, at least one optical waveguide 771 is defined within an electro-optic substrate 300. The electro-optic substrate 300 includes an electro-optic polymer core layer for defining the optical waveguide 771 where a transverse refractive index discontinuity exists for the purpose of providing lateral confinement of the optical signal. An upper polymer cladding layer 770 and a lower polymer cladding layer 783 guide the lightwaves or optical signal within the optical waveguide 771. A conductive layer for the MS signal conductor 220 and CPW transmission line 100 is similarly processed as the polymer layers by patterning a common conductive layer on the top surface 320 of the polymer substrate 300. Likewise, another conductive layer for the MS ground plane 260 and protrusion 261 is similarly processed by patterning the common conductive layer on the bottom surface 360 of the polymer substrate 300.

For mechanical support, the electro-optic substrate 300 sits on a second substrate 318, such as Corning's 7070 Wafer glass, available from Corning Incorporated. Other materials for the second substrate 318 can be silicon or other semiconductor (Si, GaAs, InP, etc.), alumina ($Al_2O_3$) or other ceramic, glass ($SiO_2$), or polymer, such as polycarbonate, polyurethane, polyesther, polysulfone, polymethylmethacrylate or other suitable compounds.

Referring to FIG. 3, an electrode structure, including the microstrip (MS) transmission line 200, is disposed around the electro-optic substrate 300. The electrode structure includes four broadband interconnection devices 10 for interconnecting the microstrip 200 to the coplanar waveguide (CPW) transmission line 100 for a double-sided, push-pull modulator as shown in FIG. 3. It is to be appreciated that the circled CPW to MS transition 10 in FIG. 3 is shown magnified in the two top expanded representations above with magnified divergent and convergent lines and simplified straight lines below in the two bottom representation of the same transition 10. Alternatively, two interconnection devices 10 can be used, instead of four, for a conventional single-sided drive, a single-sided, push-pull, split conductor drive, or a single-sided, push-pull drive modulator as known variations of optical intensity modulators.

Assuming the substrate 300 is polymeric, the modulator 700 becomes an electro-optic (EO) polymer modulator. EO polymer waveguide geometries usually favor the microstrip (MS) transmission line 200 for use as a drive electrode due to typical fabrication techniques, waveguide dimensions, and polymer material properties. Typically, the width of the MS signal conductor or strip 220 is about 20–25 microns (μm). In FIG. 2 and FIG. 3, the width of the MS signal conductor will be assumed to be 20 μm, for simplicity.

One example of how a MS transmission line 200 is used and connected is shown in FIG. 3. A drive signal 720, serving as an RF input, is applied to the elevated MS signal conductor or strip 220 by way of the wider surface CPW signal or central conductor 120 from the uniplanar transition 10 which more easily accepts the drive signal packaging top surface feedthrough pin 702 along with the ground surface packaging pins 721 and 722. The MS signal conductor 220 is insulated by the dielectric of the substrate material 300 (seen in FIG. 1) from the microstrip ground plane 260.

High frequency electrical connectors 730, which carry a modulation signal 782 via another packaging feedthrough pin 702 from the signal source or drive signal 720 through the package wall to the modulator 700, typically favor an interior connection of the planar packing signal 702 and ground pins 721 and 722 to the coplanar waveguide (CPW) transmission line 100. In the CPW transmission line 100, the center, central, or signal CPW conductor 120 carries the drive signal 720, provided by the signal pin 702, and the two outer or ground CPW conductors 121 and 122 are grounded by the packing ground pins 721 and 722. Practical, low-loss, CPW transmission lines 100 designed for a characteristic impedance $Z_0$ of substantially 50 ohms (Ω) will usually have wider center or signal conductor 120 dimensions much larger than a comparable MS signal conductor 220. This wider CPW center or signal conductor 120 dimension is also necessary to accommodate the center conductor diameter (typically several hundred microns) of the electrical package feedthrough pins 702, 721, and 722. It is therefore advantageous to have a transitional structure 10 (FIGS. 1–2) that efficiently couples the CPW 100 and MS 200 transmission lines (the circled regions 10 in FIG. 3). This transition 10 is capable of broadband operation (DC to 50 GHz) with low propagation or return loss (less than 15 dB), while maintaining the correct impedance match of the characteristic impedance throughout the transition: preferably about 50 Ohms for compatibility with standard drive electronics 784. Abrupt changes in the electrical field vector profile or field distribution are avoided in the transition region 10 for field conservation. Uniplanar transitions 10 are preferable to out-of-plane transitions due to the extreme difficulty in fabricating vertical adiabatic tapers in production level volumes.

The circled CPW to MS transition 10 in FIG. 3 is shown magnified in the two top expanded representations above with different divergent and convergent lines and simplified straight lines below in the bottom representation of the same transition 10. To avoid an abrupt transition between the two dissimilar transmission lines of the CPW and MS signal conductors 120 and 220 on a coplanar transition on the top surface only, a bottom ground transition is also provided by the at least one ground MS protrusion 261. Referring to FIG. 1 where the dimensions are not drawn to scale but exagerated in parts to better illustrate the invention, the MS signal conductor 220 has a width 222 $W_m$=20 $\mu$m, a dielectric height 322 H=10 $\mu$m (such a height is too small to show clearly and hence is greatly exagerated in FIG. 1), and a conductor thickness 223 T=3 $\mu$m. The fabrication and transmission line problems in maintaining the same characteristic impedance across the two CPW and MS line segments arise from the fact that in order to gradually taper the wider signal conductor CPW line down to the width of the narrower MS line, the CPW gap, G, at the widest spacing of the gap trench intersection 11 or the nominally gap spacing for typically straight CPW conductors for minimum discontinuity will have to decrease correspondingly to approximately 3.5 $\mu$m. Such a small CPW gap width results in substantial RF propagation loss, especially at high frequencies.

However, referring to FIGS. 3–5, regardless of matching impedance, the electric field distributions of the CPW and MS lines will have relatively poor field conservation, without a MS ground compensation provided by the at least one ground protrusion 261. It is known that the electric field distribution 481 is primarily concentrated horizontally or at the sides of the center or signal conductor 120 for the CPW transmission line 100, especially at the point 11. From FIGS. 4–5, the electrical field distribution 482 is vertical or underneath the signal conductor 220, especially at point 718 to maximize the overlap between the optical and electrical fields for phase modulation. Without field conservation using some kind of a compensated MS ground geometric configuration, the resultant return and propagations loss is not smooth and low enough at high frequencies.

EXAMPLES

The invention will be further clarified by the following examples which are intended to be exemplary of the invention.

Example 1

Figure 7:
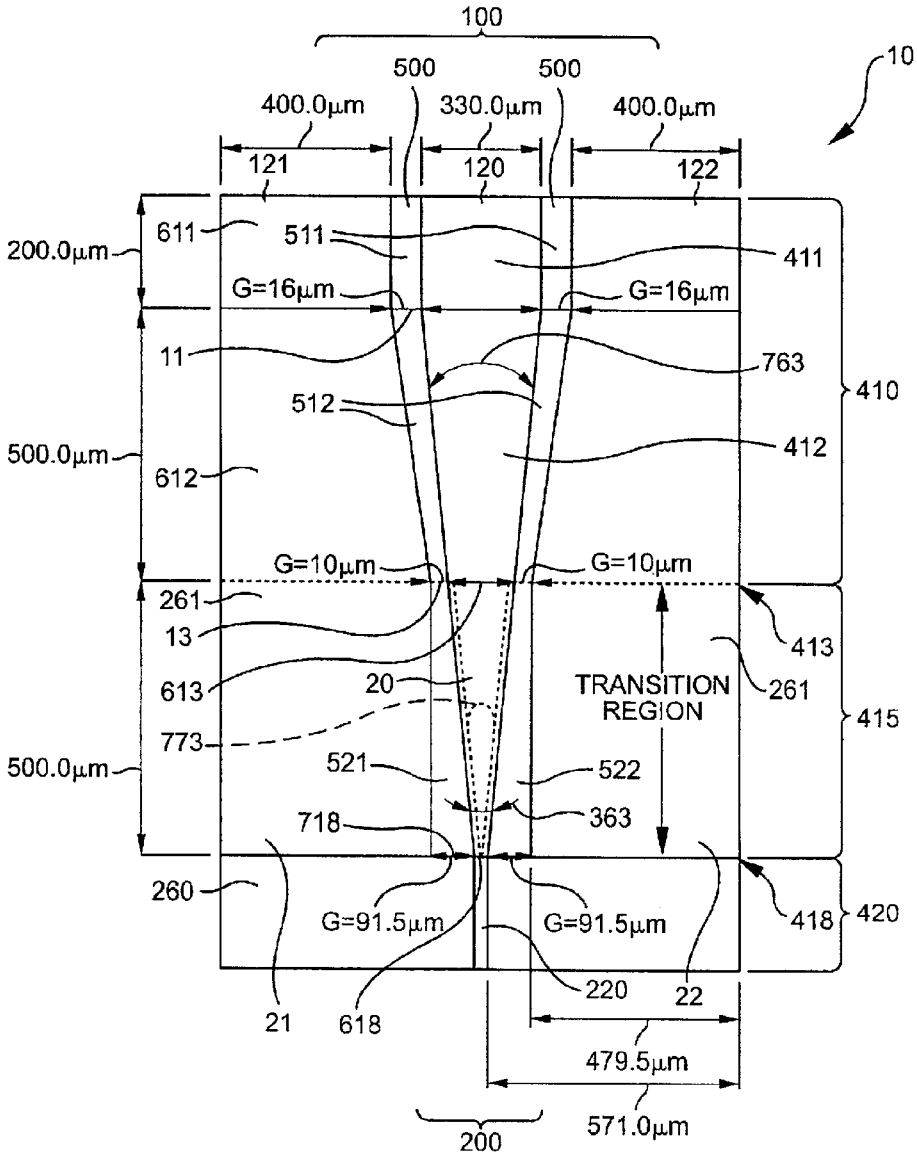
FIG. 7 is a top planar view of a second ground overlay geometrical variation of the transition 10 of FIG. 1, using an unslotted MS ground, in accordance with the present invention.

Referring to FIG. 7, another example of a microstrip ground geometrical configuration is shown. Instead of having only one ground protrusion that is aligned colinearly with the top CPW signal conductor 120, the microstrip ground geometrical configuration has two protrusions 261 that diverge or taper away at the diverging angle 773 from the top CPW signal conductor 120. Meanwhile, the top CPW signal conductor 120 is also diverging away from or converging toward the MS boundary interface 418 at the angle 763, which is just slightly larger than the MS ground diverging angle 773. The ground plane 260 starts to split, at a cut-off vertex 618, somewhere underneath the drive electrode 120 to form at least two MS ground protrusions 261. Optionally, the vertex 618 can be located before or preferably on the MS boundary interface 418, depending on the other transmission line 100 and 200 dimensions. However, the MS ground protrusions 261 could also diverge from the cut-off vertex 618, at a true vertex point, that is not cut-off but centrally aligned with the MS signal conductor 220 and just passing the MS boundary interface 418. By spreading a true vertex apart to form the cut-off vertex 618 at the MS boundary interface 418, capacitance at the MS transition boundary location 418 under the center CPW signal conductor 20 is reduced to allow a more gradual transition into the vertical electric fields. The sides of the MS ground protrusions 261 diverge from this cut-off vertex 618 at one slope related to the angle 773, which is slightly less than the angle 763 of the CPW signal conductor 120, until the substantially CPW interface boundary 413 (where G=10 $\mu$m), from which the protrusions 261 ends in a linear edge or a curvilinear edge that diverge away or taper from the substantially CPW interface boundary 413 at a second much steeper slope (not shown) that is much greater than the CPW signal conductor angle 763 toward the more CPW side of the transition 413. Hence, this second steeper slope can start a curvilinear edge (not shown), instead of being a linear side coincident with the substantially CPW interface boundary 413 as shown. With a linear side, at point 13, the MS ground protrusion 261, stops diverging and turns a corner to form the linear side and then starts to be completely overlapped by the top CPW ground portions and bounded by the nonuniform CPW ground portion 612. It is to be appreciated that the linear sides are shown only for simplicity. As mentioned before, the sides can be exponential or follow other microwave adiabatic shapes.

This divergence pattern in the MS ground protrusions 261 result in less ground capacitance at the point 718 of the MS interface 418. The narrowest gap point, now having an increased width of 10 $\mu$m, normally at the MS interface boundary point 718, with a normally narrower width of about 3.5 $\mu$m can now be moved to the point 13 on the coplanar waveguide interface boundary 413, where there is an equal mix 483 of vertical and horizontal fields as seen in FIG. 5 and mostly horizontal electric field lines before point 13. Hence, the typically mixed fields of a conventional uncompensated transition is moved away from the microstrip interface boundary point 718. Instead of having a normally mixed field at the uncompensated abrupt transition, the electrical field distribution 482 of FIGS. 4–5 is now substantially all vertical at the point 718 for maximizing the vertical optical field excitation underneath.

Alternatively, each of the two protrusions 261 has a curvilinear edge (not shown) closest to the CPW signal conductor 120 and CPW ground 122 or 121, underneath the nonuniform CPW ground portions 612, to more gradually reduce or taper the horizontal capacitance contributing to the horizontal fields toward the CPW 100. Correspondingly, each of the CPW ground end portions 22 and 21 has a corresponding curvilinear edge (not shown) closest to the MS signal conductor 220 and MS ground 260 and 261 to more gradually reduce or taper the vertical capacitance contributing to the vertical fields toward the MS 200. In such a way, the vertical and horizontal changes 492 and 491 result to more closely follow the linear lines 482 and 481 of FIG. 5.

In accordance with the teachings of the present invention, modification to the MS ground plane 260 of an uncompensated transition region 418 with such an addition of the two protrusions 261, with a resultant compensation in the CPW ground end portions 21 and 22 is taught to minimize reflection and radiation losses from an uncompensated typical interface. The first modification or transition is the gradual introduction of the microstrip ground plane 260 in a manner, such as with the addition of the two MS ground protrusion 261, which prevents the impedance of the CPW line 100 from drifting high, while simultaneously rotating the electric field vector from a primarily horizontal to a primarily vertical axis, as in FIG. 4. In the second modification or transition, each of the CPW ground planes 121 and 122 are gradually withdrawn in the pair of CPW ground conductor end portions 21 and 22 to prevent any abrupt discontinuities in the electric field profile. Such a tapered design allows the CPW gap trench 500 to remain relatively wide, ranging from about 91.5 μm, at point 718, to 10 μm, at point 13, thereby reducing the high RF propagation loss associated with uncompensated narrow gaps, such as 3.5 μm. Using transmission line calculations, the minimum gap width of 10 μm gap is derived given the width of the CPW center conductor 120, and the dielectric constant 3.5 of the polymer material. For fabrication simplicity, this minimum gap width of 10 μm is also the height 322 of FIG. 1 of the polymer substrate 300. The impedances of the two transmission lines are maintained, point by point, at about 50 Ω continuously from the CPW input section 100, at the coupling with the RF electrical connector 730 of FIG. 3, through the transition 10 at the MS boundary interface 418 and into the output MS section, on top of the optical waveguides 771.

Hence, by providing a resultant convergence of the gap trench 500, within the separation of the nonuniform CPW ground portions 612 and the nonuniform CPW signal conductor portion 412, and divergence pattern, within the separation of the CPW ground end portions 21 and 22 and the CPW signal conductive extension 20, the resultant changing capacitance gradually changes the horizontal electrical field lines of the CPW transmission line 100 to the vertical electric field lines of the MS transmission line 200. A corresponding convergence pattern of the CPW ground end portions 21 and 22 converge from the MS interface boundary 418 to the point 13 on the substantially CPW interface boundary 413 while the nonuniform CPW ground portions 612 diverge from the same point 13 for field conservation.

Example 2

Figure 8:
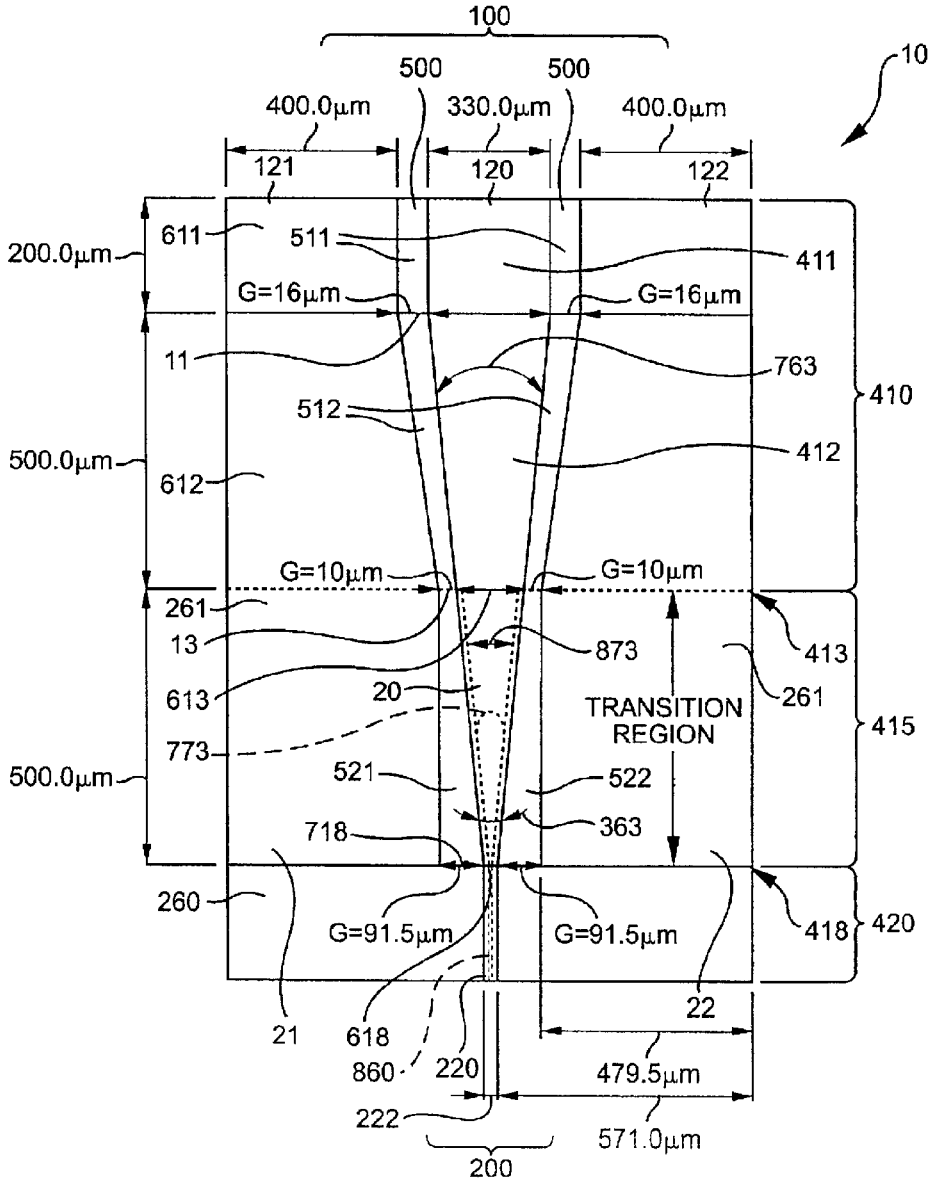
FIG. 8 is a is a top planar view of a third ground overlay geometrical variation of the transition 10 of FIG. 1, using a slotted MS ground, in accordance with the present invention.

Referring to FIG. 8, a coplanar waveguide (CPW) to a slotted-ground microstrip (SGMS) transition is shown. Another name for the CPW-SGMS transition is a coupled microstrip-slotline coplanar transmission line structure. The main difference in this example of the EO polymer modulator 700 of FIG. 3 is the MS transmission line now having a slotted ground electrode. Hence, the MS ground plane 260 is shown with a central slot or aperture 860 and hereafter together referred to as the slotted-ground microstrip (SGMS). Advantages of the SGMS include the possibility of a wider drive electrode having the maximum width 411 in the CPW signal conductor 120, an enhancement of the RF field near the optical waveguide cores 771 underneath in FIG. 3, and better coupling efficiency with a coplanar transmission line because the underlying MS ground is not present in the slot 860. The SGMS has several parameters that can be varied to produce a 50 Ω impedance. These include the drive electrode width of the signal conductor ($W_m$) 222, the dielectric height (H) 322 as shown in FIG. 1, and the ground slot width ($W_s$) 873 which is slightly larger or smaller than the MS conductor width 222, depending on dielectric width and other transmission line parameters. This ability to change several parameters of the SGMS allows simultaneous optimization of both the RF transmission and EO operation of the modulator 700 of FIG. 3.

Optimizing the coupling between the CPW 100 and SGMS 200 transmission lines requires a similar gradual introduction of the ground plane 260. In this case, however, the ground plane 260 remains split with the two protrusions 261 underneath the CPW drive electrode 120 and the MS signal conductor 220. The two protrusions 261 diverge from the slot 860. Instead of converging to the cut-off vertex 618 of FIG. 7, at the point centrally aligned with the MS signal conductor 220 and on the MS boundary interface 418 in the non-slotted geometrical configuration, the two protrusions 261 taper from the wider spacing of the nonuniform portion of a slot trench 873 to a narrower and uniform portion of the slot trench 873 forming the actual slot 860.

Because the horizontal electric fields of the CPW 100 and SGMS 200 lines are similar, only a small perturbation is required to transition the electric field component orientations to maintain a 50 Ω impedance SGMS-CPW transition. Both the CPW 100 and SGMS 200 transmission lines concentrate the electric field to the sides of the drive electrode 120. Because of this significant mode overlap that already exists between the transmission lines 100 and 200, the transition requirements are reduced. For example, the tapering angles 763 and 773 need not be as sharp. Also, the transition to the SGMS line is easier to fabricate than the transition to a standard MS line. In FIG. 7, the standard MS transition, without the slot 860, requires a sharp feature or an indentation at the cut-off vertex 618 in the ground plane 260, but the SGMS transition replaces this sharp feature at 618 with the more gradual transition of the adiabatic narrowing spacing of the nonuniform portion of the slot trench 873 that gradually narrows into the MS ground plane slot 860 in FIG. 8 at the point 618. This allows the SGMS line 200 in FIG. 8 to either act as the modulation electrode directly via the top connection to the CPW signal conductor 120 or as an intermediate transition to a standard MS transmission line, without the slot 860. Such a SGMS transmission line 200 is especially desirable for driving push-pull poled, electro-optic polymer modulators with a single drive electrode.

In summary, compared to transitions seen in the related art, the present invention for transition from CPW 100 to MS 200 transmission lines (whether slotted 860 or not) include various advantages. For minimum discontinuity, the 50 Ω line impedance is maintained continuously throughout the transition element 10 by following the dimensional constraints of transmission line theory. The gradual introduction of the MS ground plane 260 by the extension of the at least one ground protrusion 261 and gradual withdrawal of CPW ground plane 21 and 22 lead to an adiabatic rotation of the electric field from a primarily horizontal to a primarily vertical axis, as seen in FIG. 5. By providing the extra MS ground protrusion 261, a wider-gap CPW structure 100 results which avoids a high propagation loss.

Because of the wider gaps 500, the modulator 700, including its at least one electrical transition 10, is easier to fabricate and will produce higher yields. Broadband (DC to 50 GHz) operation of the modulator 700 is thus achieved through the elimination of any intrinsically resonant devices such as mode-coupling filters or radial tuning stubs. Each of the top and bottom transitions for the top CPW-MS signal conductor coupling 20 and ground MS extension or protrusion 261 is uniplanar, eliminating the need for out-of-plane transitions in the related arts, which have higher intrinsic losses and are more difficult to fabricate.

It will be apparent to those skilled in the art that various modifications and variations can be made to the present invention without departing from the spirit and scope of the invention. For example, the bottom at least one MS ground protrusion 261 of FIG. 2, the separation or divergence 773 between the two MS ground protrusions 261 in FIGS. 7–8, and the slot 860 in FIG. 8 can have at least a portion that is wider to not be completely shawdowed or overlapped by the top CPW signal 20 and MS signal 220 conductors, as shown by the simplistic bottom representation of 261 in the circled representation 10. Thus, it is intended that the present invention cover the modifications and variations of this invention provided they come within the scope of the appended claims and their equivalents.

What is claimed is:

1. A broadband transmission line interconnection device, the device comprising:

a first transmission line having a first ground on a first plane; and a second transmission line having a second ground on a second plane, wherein the second ground shape is geometrically configured to interact with the first ground for maintaining a uniform desired characteristic impedance for broadband micro-wave signal propagation between the first and second transmission line;

a substrate having the first transmission line defined at a first side on a first surface, the first transmission line including a signal conductor and at least one ground conductor for providing the first ground, a signal conductor at the second transmission line defined on an opposite side of the first surface, and the second ground of the second transmission line on an opposed surface, the signal conductor of the first transmission line being electrically connected to the signal conductor of the second transmission line on the first surface; and the second around of the second transmission line, on the opposed surface, having at least one protrusion aligned with the signal conductor of the first transmission line.

2. The device of claim 1, further comprising a pair of sloped surfaces in the substrate, the pair of sloped surfaces sloping from the at least one ground conductor of the first transmission line on the first surface to the second ground of the second transmission line on the opposed surface, the pair of sloped surfaces being metalized with high conductivity metal, the high conductivity metal being in contact with the second ground of the second transmission line and the at least one ground conductor of the first transmission line, wherein the sloped surface subtends an angle of no less than seventy degrees and no more than ninety degrees with the second pound of the second transmission line and the at least one ground conductor of the first transmission line.

3. The device of claim 1, wherein the first transmission line comprises a coplanar waveguide (CPW) and the second transmission line comprises a microstrip (MS).

4. The device of claim 1, wherein the second ground comprises a ground plane having at least one slot.

5. The device of claim 1, wherein the at least one protrusion of the second ground comprises a taper.

6. The device of claim 1, wherein the substrate comprises an electro-optic dielectric providing a continuous transmission path with the first and second transmission lines at the uniform desired characteristic impedance from the first side to the opposite side.

7. The device of claim 1, wherein the at least one protrusion symmetrically aligned with the signal conductor of the first transmission line is gradually tapered to provide a gradual vertical capacitance change between the first and opposed surfaces that is substantially equal to a gradual horizontal capacitance change provided between the signal conductor of the first transmission line and the at least one ground conductor on the first surface to gradually rotate a horizontal electric field to a vertical electric field.

8. The device of claim 1 wherein the device comprises a modulation electrode for use in an electro-optic modulator.

9. A broadband coplanar waveguide (CPW) transmission line to microstrip (MS) transmission line transition providing a continuous transmission path, the transition comprising:

a coplanar region having a CPW central conductor of a finite width portion and a nonuniform width portion, each portion correspondingly disposed between a uniform width portion and a nonuniform width portion of a left ground conductor and a right ground conductor on a first surface to support a horizontal electric field between the CPW central conductor and the left and right ground conductors;

a microstrip region having a MS signal conductor on the first surface and a microchip ground plane on an opposed surface for supporting a vertical electric field with the signal conductor; and a transitional region bounded by a microstrip interface boundary and a coplanar waveguide interface boundary, the transitional region comprising:

a conductive extension of the CPW central conductor of the coplanar region electrically connected with the MS signal conductor of the microstrip region on the first surface between the microstrip interface boundary and the coplanar waveguide interface boundary;

at least one ground protrusion of the microstrip ground plane on the opposed surface of the microstrip region aligned with the central conductor of the coplanar waveguide to form a grounded closed conductive path opposite the central CPW connector of the coplanar region for supporting a gradual transfer of the horizontal electric field of the coplanar region to the vertical electric field of the microstrip region distributed about the central CPW conductor, wherein the at least one ground protrusion protrudes from the microstrip interface boundary and gradually approaches the coplanar waveguide interface boundary; and a pair of CPW ground conductor end portions of the left and right ground conductors on the first surface of the coplanar region aligned with the at least one MS ground protrusion on the opposed surface of the opposed microstrip ground plane of the microstrip region, wherein the pair of ground conductor end portions extend from the coplanar waveguide interface boundary and gradually approaches and intersecting the microstrip interface boundary where the pair of CPW ground conductor end portions are maximally coincident in an orthogonal plane with the at least one MS ground protrusion such that the horizontal electrical field lines of the pair of CPW ground conductor end portions gradually converge with the vertical electrical field lines of the at least one MS ground protrusion and the horizontal electric field lines of the at least one MS ground protrusion gradually diverge inside the transitional region between the microstrip and coplanar waveguide interface boundaries.

10. The transition of claim 9, wherein the at least one ground protrusion converges toward the conductive extension of the CPW central conductor.

11. The transition of claim 9, wherein the at least one ground protrusion diverge away from the conductive extension of the CPW central conductor.

12. The transition of claim 9, further comprising a pair of gap trenches having a nonuniform width transitional gap end portion for isolating the conductive extension of the CPW central conductor from the pair of CPW ground conductor end portions, wherein the conductive extension and the end portions are nonuniform.

13. The transition of claim 12, wherein the at least one ground protrusion is formed by patterning of a common conductive layer on the opposed surface to provide an adiabatic taper converging to an apex on the microstrip interface boundary, wherein the relationship of the convergence of the at least one ground protrusion is related to the divergence of the pair of ground conductor end portions as defined by the nonuniform width transitional gap end portions.

14. The transition of claim 9, wherein the at least one ground protrusion comprises a triangular common conductive layer on the opposed surface.

15. The transition of claim 9, wherein the pair of ground conductor end portions overlap a portion of the at least one ground protrusion of the microstrip ground plane.

16. The transition of claim 9, wherein the at least one ground MS protrusion is separated from the pair of ground CPW conductor end portions by a nonuniform gap spacing between the central CPW conductor and each of the left MS ground conductor and the right MS ground conductor and an unoverlapped distance between the at least one ground protrusion and the CPW conductive extension of the central conductor of the coplanar region.

17. The transition of claim 9, wherein the continuous transmission path further comprising a nonuniform gap trench having a pinched gap spacing at the coplanar waveguide interface boundary for maintaining a uniform characteristic impedance of substantially 50 ohms from the microstrip interface boundary to the coplanar waveguide interface boundary while allowing a wider gap spacing at the ends of the nonuniform gap trench.

18. The transition of claim 9, wherein the conductive extension of the central conductor of the coplanar region and of the signal conductor of the microstrip region on the first surface comprises a first transition structure for launching an electric field polarization of a signal in the CPW and the electric field polarization of the signal in the microstrip; and the pair of ground conductor end portions of the left and right ground conductors on the first surface of the coplanar region aligned with the at least one ground protrusion on the opposed surface of the opposed microstrip ground comprises a second transition structure for gradually rotating the horizontal electric field component of the electric field polarization of the signal on the CPW transmission line to a vertical electric field component of the electric field polarization of the signal on the microstrip transmission line prior to the signal entering the microstrip region.

19. An electro-optic modulator comprising:

an electro-optic substrate;

at leant one optical waveguide defined within the substrate; and an electrode structure having a microstrip disposed around the electro-optic substrate;

the electrode structure includes a broadband uniplanar interconnection device used for interconnection between the microstrip and a coplanar waveguide, comprising:

the electro-optic substrate having a coplanar waveguide defined at a first side on an first surface, the coplanar waveguide including a signal conductor and a pair of ground conductors, a signal conductor of a microstrip defined on an opposite side of the first surface, and a microstrip ground plane of the microstrip on a opposed surface, the signal conductor of the coplanar waveguide being electrically connected to the signal conductor of the microstrip on the first surface; and the microstrip ground plane of the microstrip, on the opposed surface, having at least one protrusion symmetrically aligned with the signal conductor of the coplanar waveguide.

* * * * *

UNITED STATES PATENT AND TRADEMARK OFFICE

CERTIFICATE OF CORRECTION

PATENT NO. : 6,734,755 B2
DATED : May 11, 2004
INVENTOR(S) : Jeffrey S. Cites et al.

It is certified that error appears in the above-identified patent and that said Letters Patent is hereby corrected as shown below:

Column 16,
Line 7, “microchip” should be -- microstrip --
Line 22, “connector” should be -- conductor --

Signed and Sealed this

Thirtieth Day of November, 2004

JON W. DUDAS
*Director of the United States Patent and Trademark Office*